US008276243B2

(12) United States Patent
Caveney et al.

(10) Patent No.: US 8,276,243 B2
(45) Date of Patent: Oct. 2, 2012

(54) HOOK AND LOOP TIE WITH A NON-SLIP AREA

(75) Inventors: Jack E. Caveney, Hinsdale, IL (US); David W. West, Naperville, IL (US)

(73) Assignee: Panduit Corp., Tinley Park, IL (US)

( * ) Notice: Subject to any disclaimer, the term of this patent is extended or adjusted under 35 U.S.C. 154(b) by 292 days.

(21) Appl. No.: 12/470,921

(22) Filed: May 22, 2009

(65) Prior Publication Data

US 2009/0293236 A1 Dec. 3, 2009

Related U.S. Application Data

(60) Provisional application No. 61/119,398, filed on Dec. 3, 2008, provisional application No. 61/056,127, filed on May 27, 2008.

(51) Int. Cl.
*B65D 63/14* (2006.01)

(52) U.S. Cl. ..... 24/16 R; 24/445

(58) Field of Classification Search ..... 24/445, 24/447, 448, 450, 451, 452; 428/100
See application file for complete search history.

(56) References Cited

U.S. PATENT DOCUMENTS 3,708,833 A 1/1973 Ribich et al.
4,088,136 A * 5/1978 Hasslinger et al. ..... 604/179
4,396,013 A 8/1983 Hasslinger
4,569,348 A 2/1986 Hasslinger
4,706,914 A 11/1987 Ground
4,775,310 A 10/1988 Fischer
4,794,028 A 12/1988 Fischer
4,815,172 A 3/1989 Ward
4,872,243 A 10/1989 Fischer
4,963,410 A * 10/1990 Bryant ..... 428/100
5,200,245 A * 4/1993 Brodrick, Jr. ..... 428/100
(Continued)

FOREIGN PATENT DOCUMENTS

DE 29602362 U1 1/1997
(Continued)

OTHER PUBLICATIONS

Velco Industries, N.V. product literature for Velstrap brand straps with non-slip neoprene, 1 page, date unknown.

(Continued)

*Primary Examiner* — Robert J Sandy
*Assistant Examiner* — Michael Lee
(74) *Attorney, Agent, or Firm* — Robert A. McCann; Christopher S. Clancy; James H. Williams

(57) ABSTRACT

Certain embodiments of the present invention provide a hook and loop tie for securing a bundle of cables. The hook and loop tie comprises a loop component, a hook component, and a non-slip component. The loop component has a first end, a second end opposite the first end, and a plurality of loop fastening elements. The hook component is affixed to the loop component, extends from the first end of the loop component toward the second end of the loop component, and has a plurality of hook fastening elements. The non-slip component is affixed to the loop component, extends from the second end of the loop component toward the first end of the loop component, and overlaps at least a portion of the hook component.

19 Claims, 13 Drawing Sheets

U.S. PATENT DOCUMENTS

| | | | | |
|---|---|---|---|---|
| 5,449,128 | A * | 9/1995 | Crisci, Jr. | 242/580 |
| 5,691,026 | A | 11/1997 | Zinke et al. | |
| 5,691,027 | A | 11/1997 | Eckhardt et al. | |
| 5,786,062 | A | 7/1998 | Callahan, Jr. et al. | |
| 5,870,849 | A * | 2/1999 | Colson, Jr. | 43/25.2 |
| 6,129,964 | A | 10/2000 | Seth | |
| 6,205,623 | B1 | 3/2001 | Shepard et al. | |
| 6,481,063 | B2 | 11/2002 | Shepard et al. | |
| 7,132,144 | B2 | 11/2006 | Roberts | |
| 2003/0074768 | A1 | 4/2003 | Shepard et al. | |
| 2005/0015938 | A1 * | 1/2005 | Shepard et al. | 24/30.5 R |

FOREIGN PATENT DOCUMENTS

| | | |
|---|---|---|
| WO | 9727830 A1 | 8/1997 |
| WO | 0027235 A | 5/2000 |

OTHER PUBLICATIONS

Aplix, Inc. webpage for Coroplast knit loop with pressure sensitive adhesive backing, 1 page, Apr. 24, 2008.

* cited by examiner

HOOK AND LOOP TIE WITH A NON-SLIP AREA

CROSS REFERENCE TO RELATED APPLICATIONS

This application claims priority to U.S. Provisional Patent Application No. 61/119,398, filed on Dec. 3, 2008, and U.S. Provisional Patent Application No. 61/056,127, filed on May 27, 2008, both of which are incorporated by reference in their entireties.

BACKGROUND OF THE INVENTION

The present invention relates to a hook and loop tie. More particularly, the present invention relates to a hook and loop tie with a non-slip area for improved bundle tensioning without risk of damage to the bundle.

Hook and loop fasteners are well known in the art. Examples of prior art hook and loop fasteners include U.S. Pat. No. 5,200,245, which is incorporated by reference in its entirety, Velstrap brand straps with non-slip neoprene (Velcro Industries, N.V.), and Coroplast knit loop with pressure sensitive adhesive backing (Aplix, Inc.).

However, notwithstanding these prior art hook and loop fasteners, there is still a need for an improved hook and loop tie with a non-slip area for improved bundle tensioning without risk of damage to the bundle.

SUMMARY OF THE INVENTION

Certain embodiments of the present invention provide a hook and loop tie for securing a bundle of cables. The hook and loop tie comprises a loop component, a hook component, and a non-slip component. The loop component has a first end, a second end opposite the first end, and a plurality of loop fastening elements. The hook component is affixed to the loop component, extends from the first end of the loop component toward the second end of the loop component, and has a plurality of hook fastening elements. The non-slip component is affixed to the loop component, extends from the second end of the loop component toward the first end of the loop component, and overlaps at least a portion of the hook component.

Certain embodiments of the present invention provide a method of constructing a hook and loop tie for securing a bundle of cables. The method comprises the steps of providing a loop component, affixing a hook component to the loop component, and affixing a non-slip component to the loop component. The loop component has a first end, a second end opposite the first end, and a plurality of loop fastening elements. The hook component extends from the first end of the loop component toward the second end of the loop component and has a plurality of hook fastening elements. The non-slip component extends from the second end of the loop component toward the first end of the loop component and overlaps at least a portion of the hook component.

DETAILED DESCRIPTION OF THE INVENTION

Figure 1:
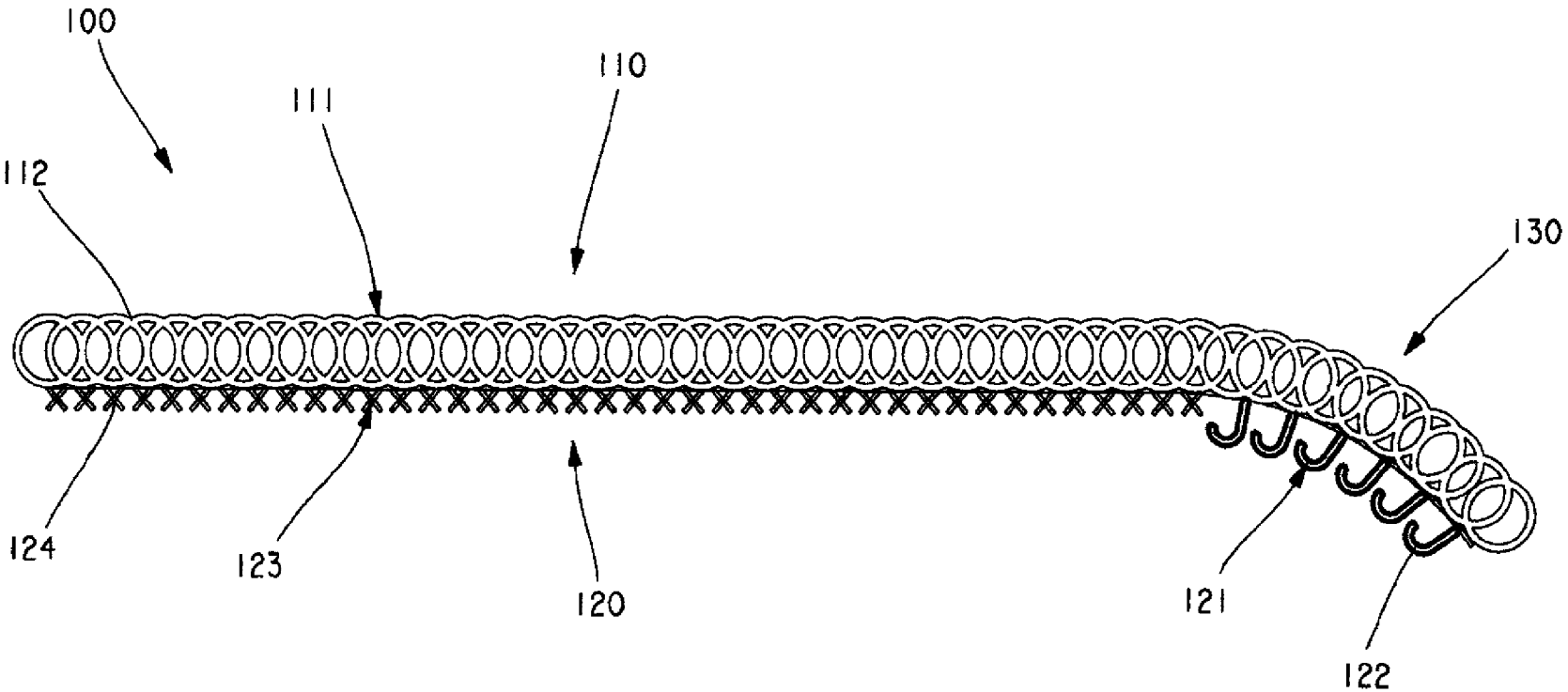
FIG. 1 is a side view of a hook and loop tie according to an embodiment of the present invention.
Figure 2:
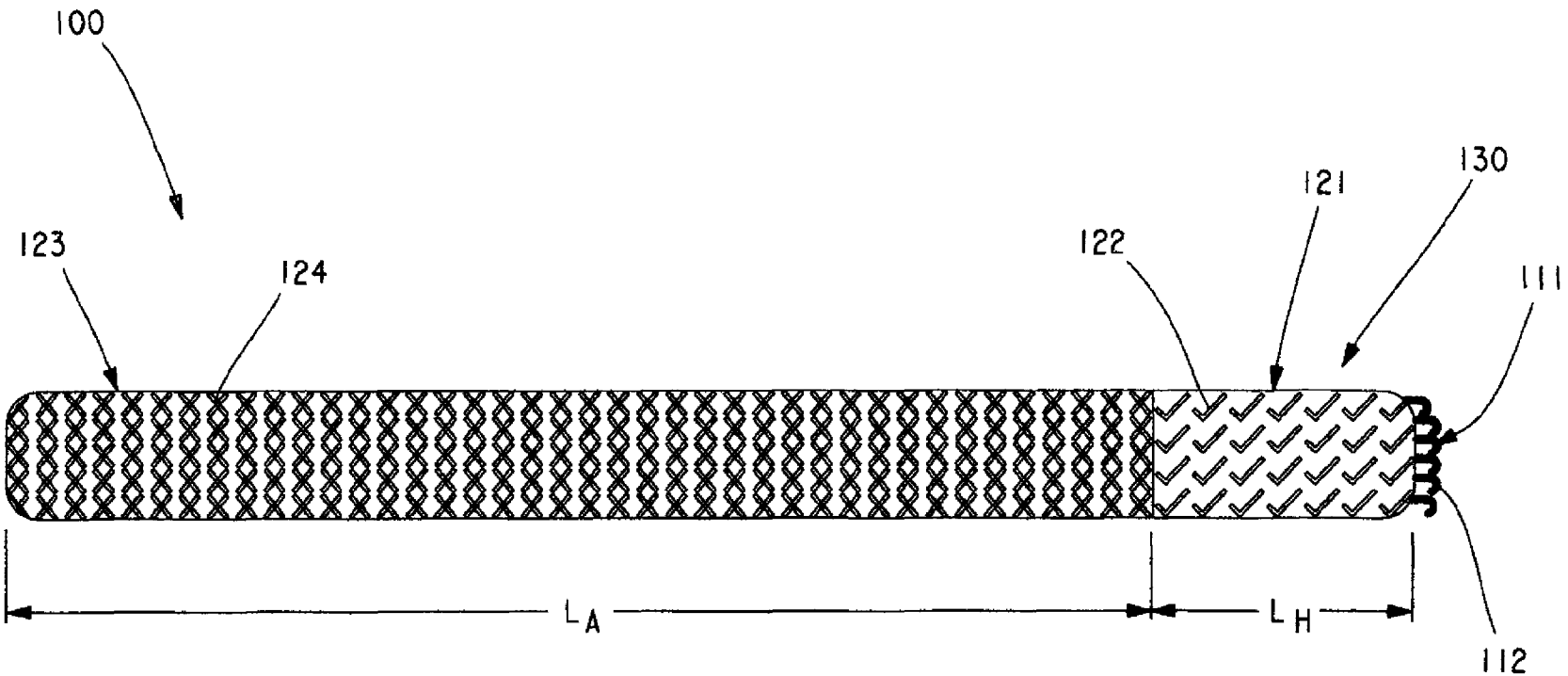
FIG. 2 is a bottom view of the hook and loop tie of FIG. 1.
Figure 3:
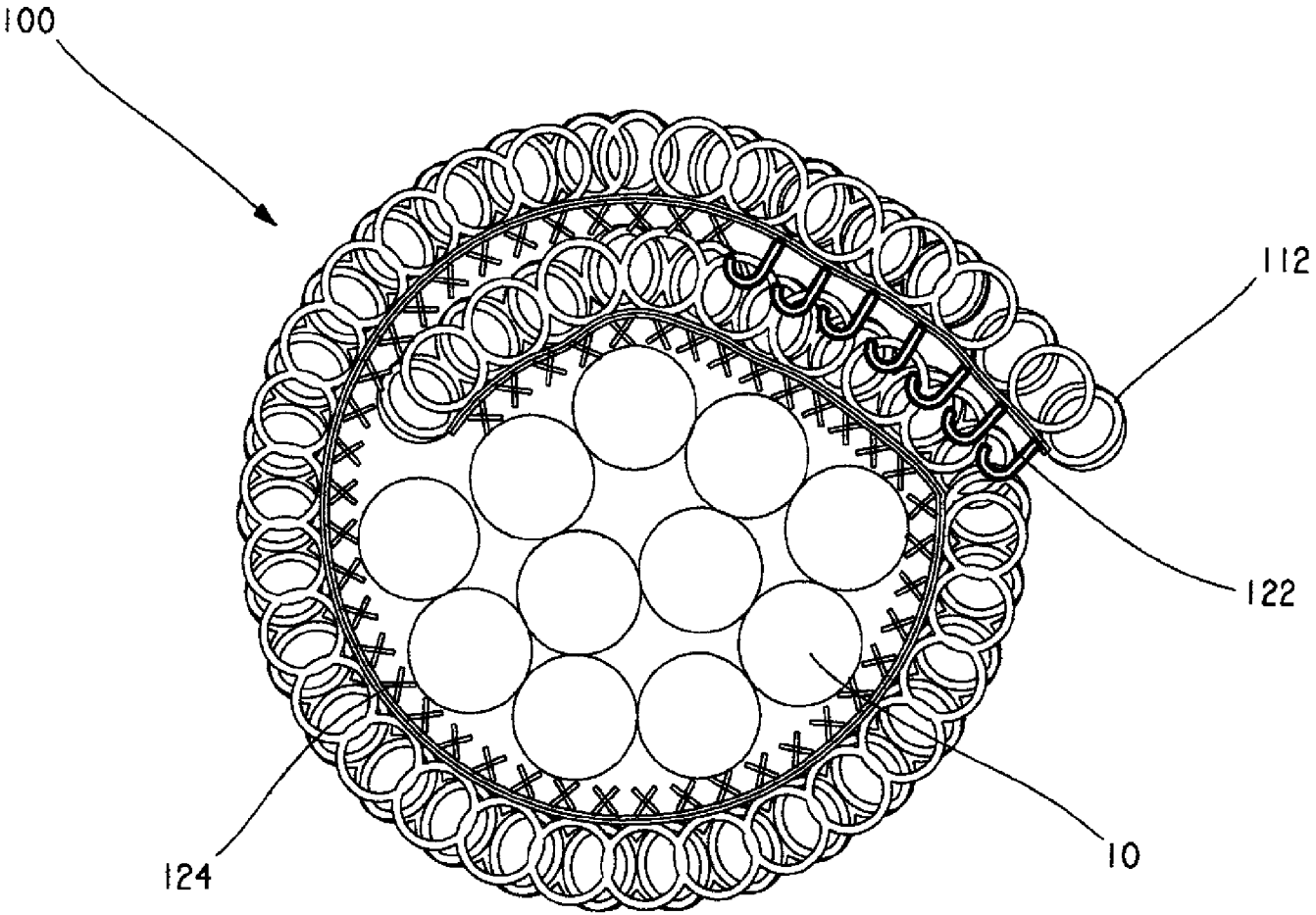
FIG. 3 is a side view of the hook and loop tie of FIG. 1, showing the hook and loop tie securing a bundle of wires.

FIGS. 1-3 illustrate a hook and loop tie 100 according to an embodiment of the present invention.

As best seen in FIG. 1, the hook and loop tie 100 includes a first side 110 and a second side 120. The first side 110 of the hook and loop tie 100 includes a loop fastening area 111. The loop fastening area 111 includes a plurality of loop fastening elements 112, such as knit loops, woven loops, or non-woven textiles suitable to mate with hooks.

The second side 120 of the hook and loop tie 100 includes a hook fastening area 121. The hook fastening area 121 includes a plurality of hook fastening elements 122. For example, the hook fastening elements 122 may be shaped like fishhooks, mushroom hooks, microhooks, or other types of hooks.

The second side 120 of the hook and loop tie 100 also includes an adhesive area 123. The adhesive area 123 includes an adhesive 124, such as a pressure sensitive adhesive. Preferably, the adhesive 124 is a releasable and/or reusable adhesive, such as a rubber adhesive used on flat back tape.

As best seen in FIG. 1, the hook and loop tie 100 includes a formed tip 130. More particularly, the formed tip 130 is arcuate. As best seen in FIG. 3, the arcuate formed tip 130 matches a shape of a bundle of wires 10. Alternatively, the formed tip 130 may be straight, bent, or otherwise formed into shapes that match a variety of bundled objects.

As best seen in FIG. 2, the length $L_A$ of the adhesive area 123 is greater than a length $L_H$ of the hook fastening area 121. That is, a majority of the second side 120 of the hook and loop tie 100 includes the adhesive area 123. Preferably, as best seen in FIG. 2, the hook fastening area 121 is limited to the formed tip 130 of the hook and loop tie 100. Preferably, as best seen in FIG. 3, the length $L_A$ of the adhesive area 123 is greater than the circumference of the wire bundle 10.

As best seen in FIG. 3, the hook and loop tie 100 is wrapped around the wire bundle 10. The adhesive area 123 holds to the wire bundle 10 while the hook and loop tie 100 is tightened around the wire bundle 10, allowing installation using one hand. The adhesive area 123 bonds to the wire bundle 10, eliminating any slippage between the hook and loop tie 100 and the wire bundle 10. The adhesive area 123 also bonds to the first side 110 of the hook and loop tie 100, securing the wire bundle 10. The hook fastening elements 122 on the hook fastening area 121 engage the loop fastening elements 112 on the loop fastening area 111, further securing the wire bundle 10. To release the hook and loop tie 100, the hook fastening area 121 is separated from the loop fastening area 111. Because the adhesive 124 is releasable, the adhesive area 123 may be separated from the first side 110 of the hook and loop tie 100 and the wire bundle 10.

In certain embodiments of the present invention, the second side 120 of the hook and loop tie 100 includes a release liner (not shown), such as paper, plastic, or other suitable material, to cover the adhesive area 123 and protect the adhesive 124 while not in use.

In certain embodiments of the present invention, the loop fastening elements 111 and the hook fastening elements 122 are interchangeable. That is, the loop fastening elements 111 on the first side 110 of the hook and loop tie 100 may be replaced with hook fastening elements 122, and the hook fastening elements 122 on the second side 120 of the hook and loop tie 100 may be replaced with loop fastening elements 111.

The adhesive area 123 may be referred to more generally as a non-slip area 123. The non-slip area 123 may include adhesives 124, such as pressure sensitive adhesives, or non-adhesives 124, such as thermoplastic elastomers (e.g., Santoprene), synthetic rubbers (e.g., Neoprene), and/or other non-adhesive tacky substrates.

FIGS. 4-7 illustrate construction details for a hook and loop tie 200 according to an embodiment of the present invention. The hook and loop tie 200 is similar to the hook and loop tie 100 of FIGS. 1-3. That is, the hook and loop tie 200 includes a loop component 210, such as a piece of loop fabric, a hook component 220, such as a piece of loop fabric, and differential tape 230, which are similar to the loop fastening area 111, the hook fastening area 121, and the adhesive area 123, respectively.

Figure 4:
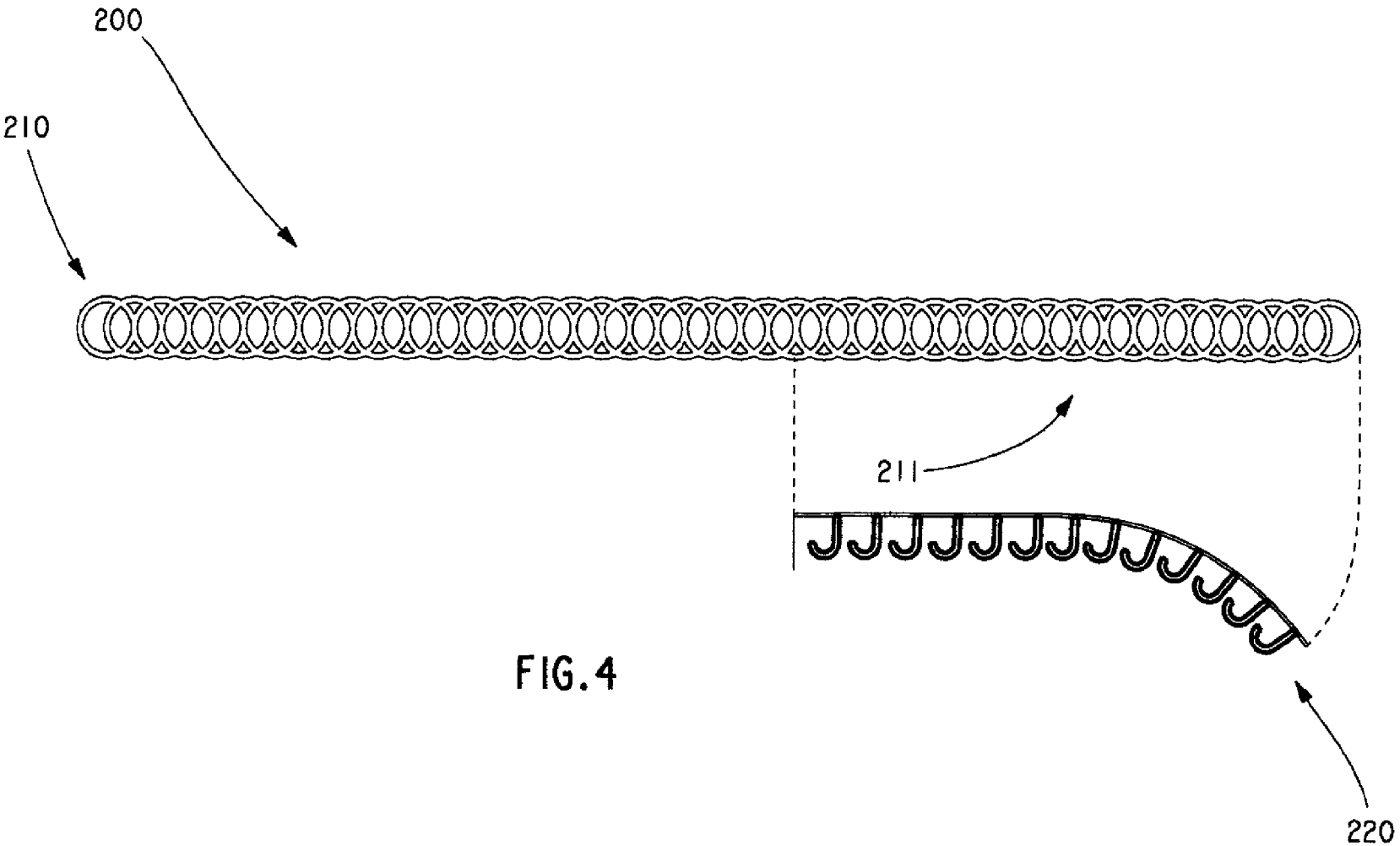
FIGS. 4-7 illustrate construction details for a hook and loop tie according to an embodiment of the present invention.

As best seen in FIG. 4, the hook component 220 is attached to the loop component 210, for example, using a permanent adhesive, such as a rubber or acrylic adhesive applied in a thick enough layer to be permanent. The hook component 220 is disposed at a distal end of the loop component 210, and covers a first portion 211 of the loop component 210. Preferably, the length of the loop component 210 is 7 inches, and the length of the hook component 220 is 3 inches. The shape of the hook component 220 is curved, as best seen in FIG. 4. The shape of the loop component 210, and thus, the hook and look tie 200, conforms to the shape of the hook component 220.

Figure 5:
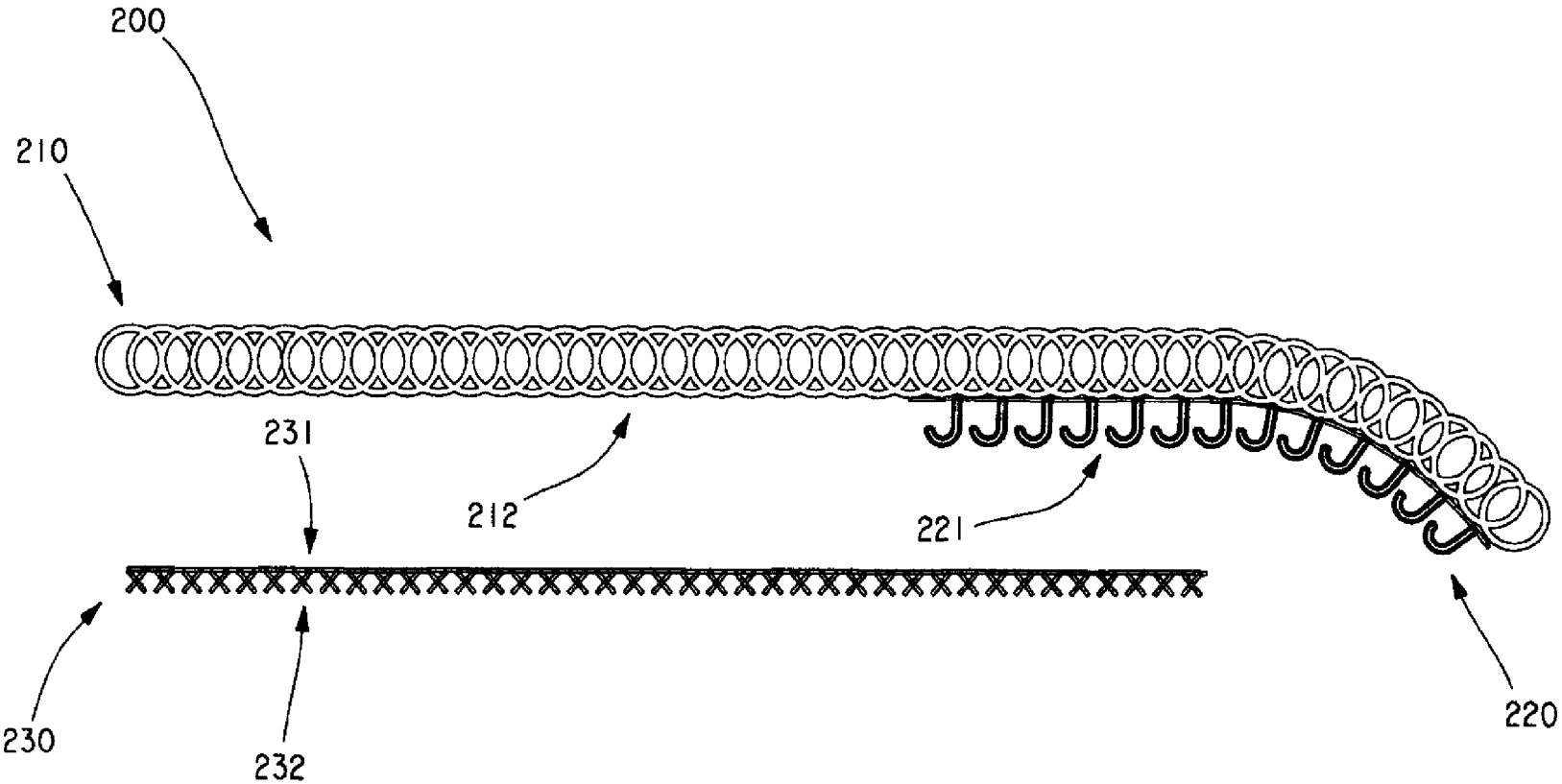

As best seen in FIG. 5, the differential tape 230 is attached to the loop component 210 and the hook component 220. The differential tape 230 covers a second portion 212 of the loop component 210, as well as a first portion 221 of the hook component 220. That is, the differential tape 230 overlaps the first portion 221 of the hook component 220, thereby increasing the overall strength of the hook and loop tie 200. Preferably, the length of the differential tape 230 is 5½ inches. In certain embodiments of the present invention, the first portion 221 of the hook component 220 may be flattened (not shown).

Figure 6:
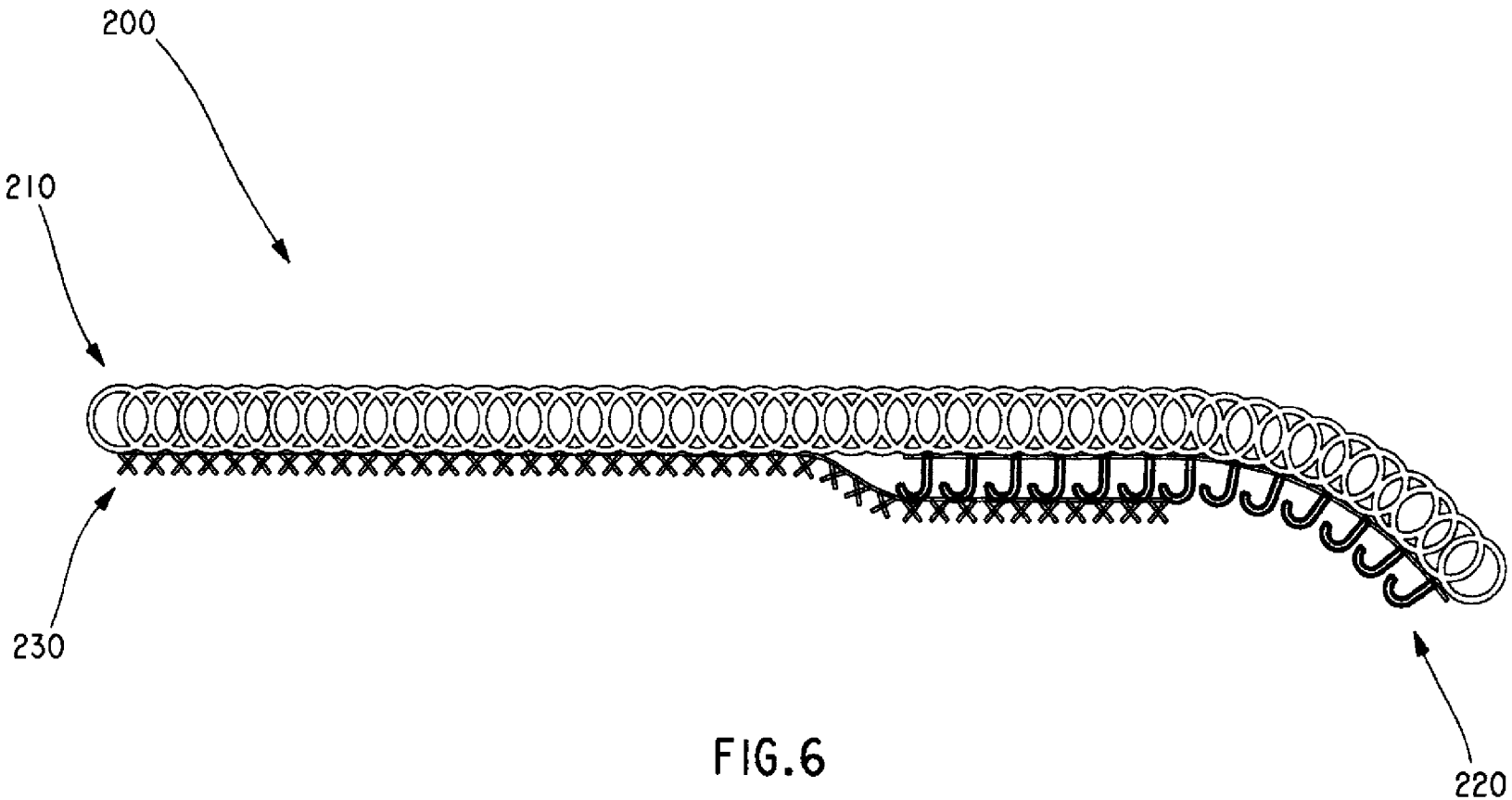
Figure 7:
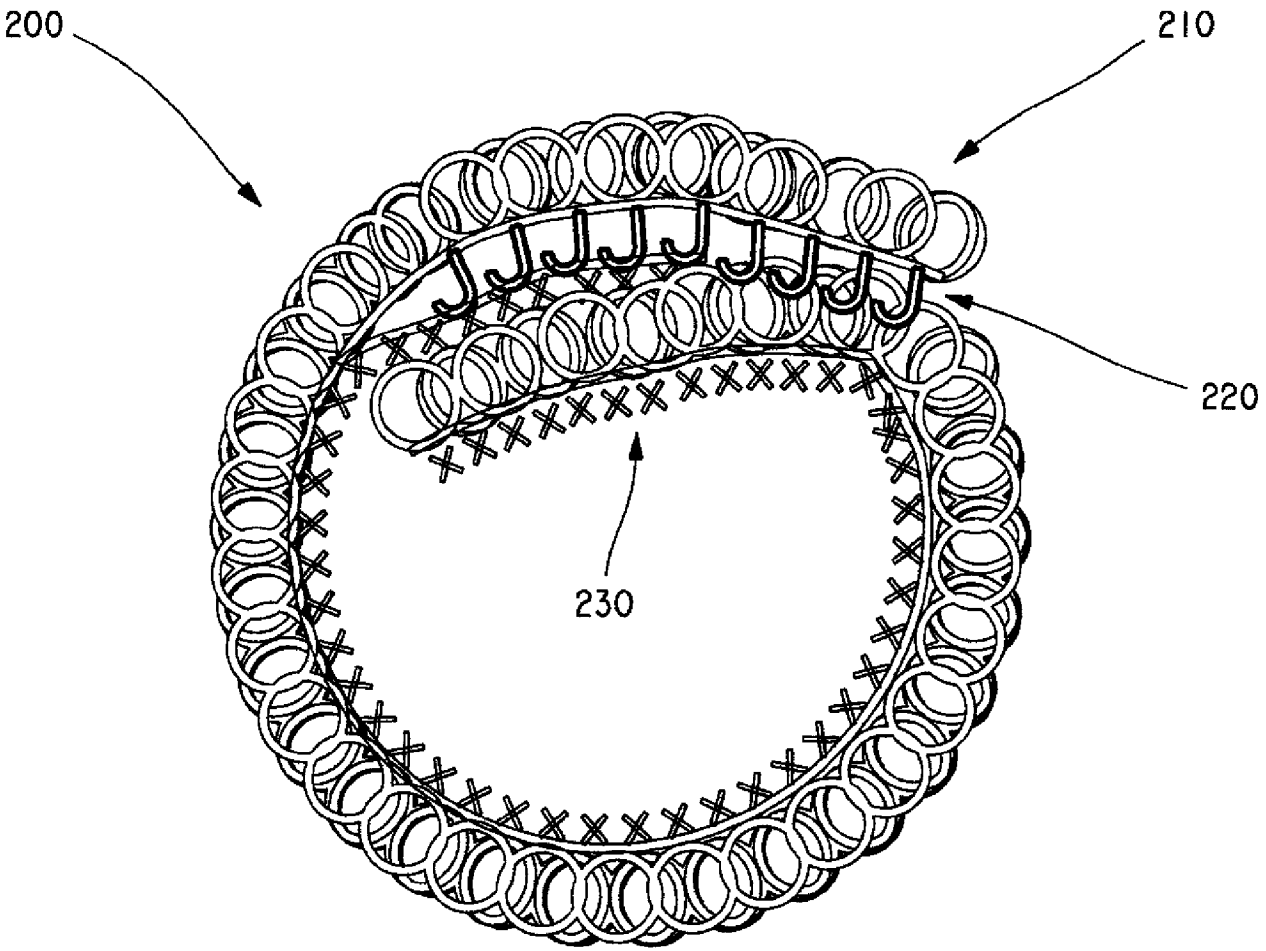

The differential tape 230 includes a first side 231 and a second side 232. The first side 231 includes a first adhesive, such as a permanent adhesive, for securing the differential tape 230 to the loop component 210 and the first portion 221 of the hook component 220. The second side 232 includes a second adhesive for securing the hook and loop tie 200 to a bundle of cables (not shown). Preferably, the second side 232 of the differential tape 230, which contacts the bundle of cables, is similar to flat back tape, which is stronger than masking tape and removable without leaving a residue. A finished hook and loop tie 200 is shown in FIG. 6. A bundled hook and loop tie 200 is shown in FIG. 7.

Figure 8:
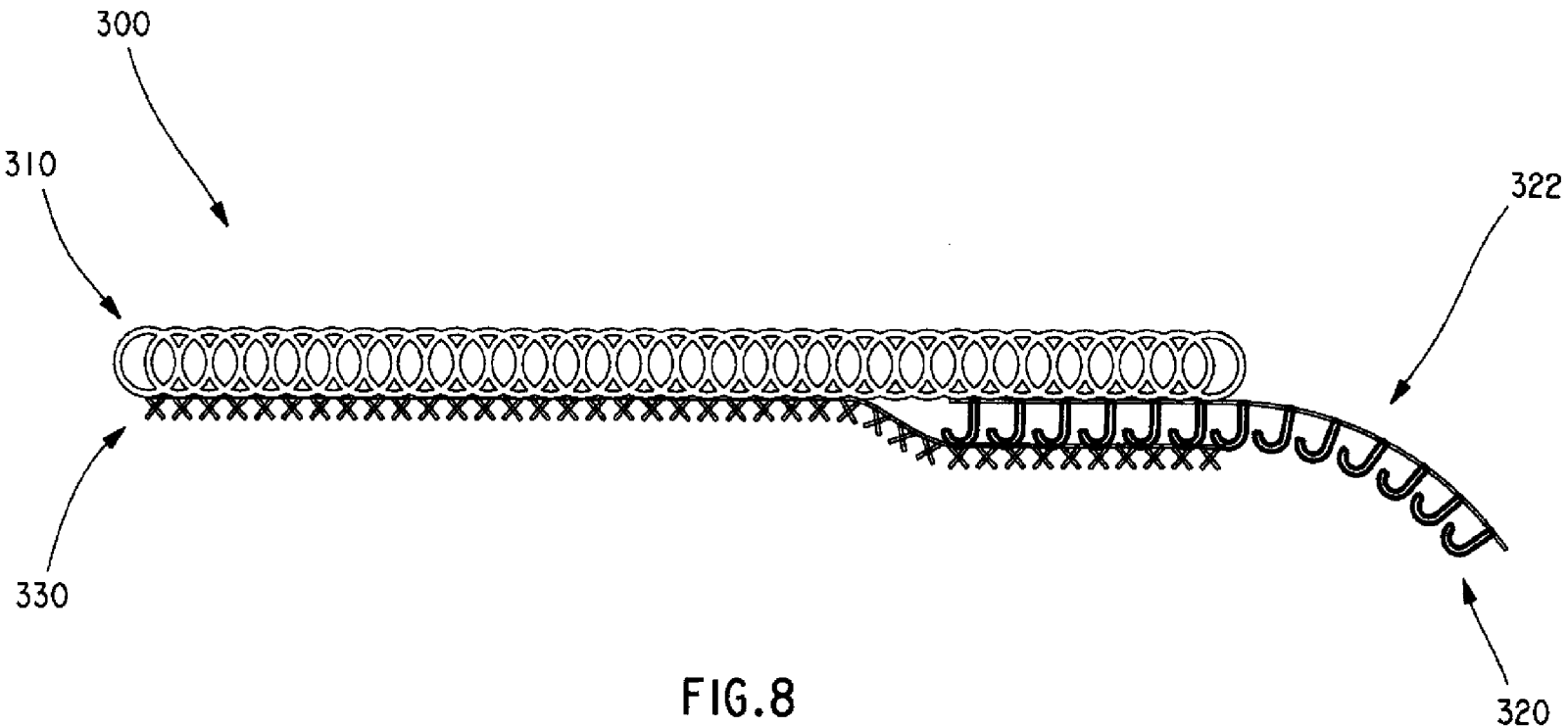
FIGS. 8-9 illustrate construction details for a hook and loop tie according to an alternative embodiment of the present invention.
Figure 9:
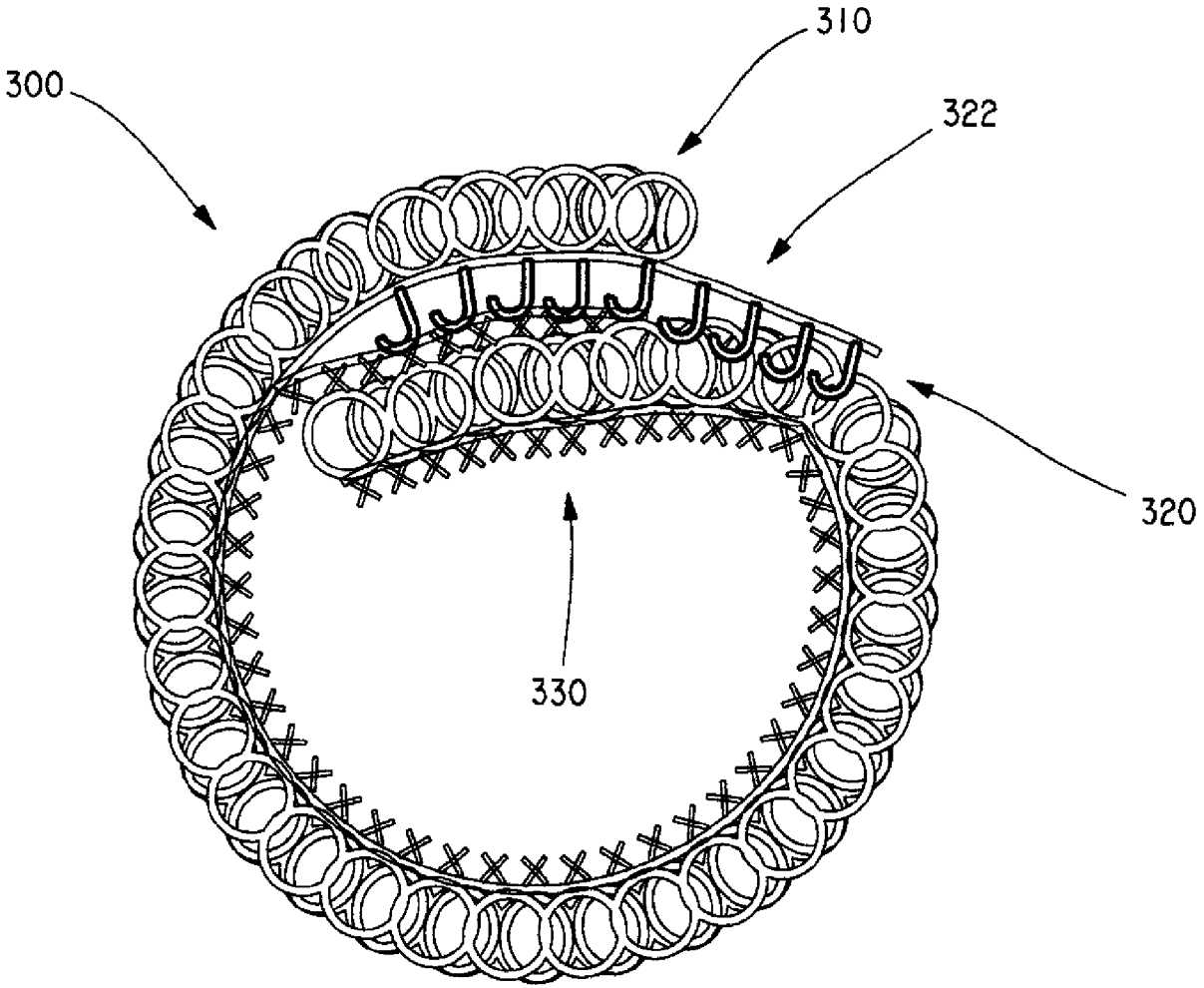

FIGS. 8-9 illustrate construction details for a hook and loop tie 300 according to an alternative embodiment of the present invention. The hook and loop tie 300 is similar to the hook and loop tie 200 of FIGS. 4-7. That is, the hook and loop tie 300 includes a loop component 310, such as a piece of loop fabric, a hook component 320, such as a piece of hook fabric, and differential tape 330, which are similar to the loop component 210, the hook component 220, and the differential tape 230, respectively. However, unlike the hook and loop tie 200, a second portion 322 of the hook component 320 extends beyond a distal end of the loop component 310, as best seen in FIG. 8. In certain embodiments of the present invention, the second or extended portion 322 of the hook component 320 provides the following advantages: (1) a lower profile; (2) an area on which to write; (3) easier removal; and (4) less loop component. A finished hook and loop tie 300 is shown in FIG. 8. A bundled cable tie 300 is shown in FIG. 9.

Figure 10:
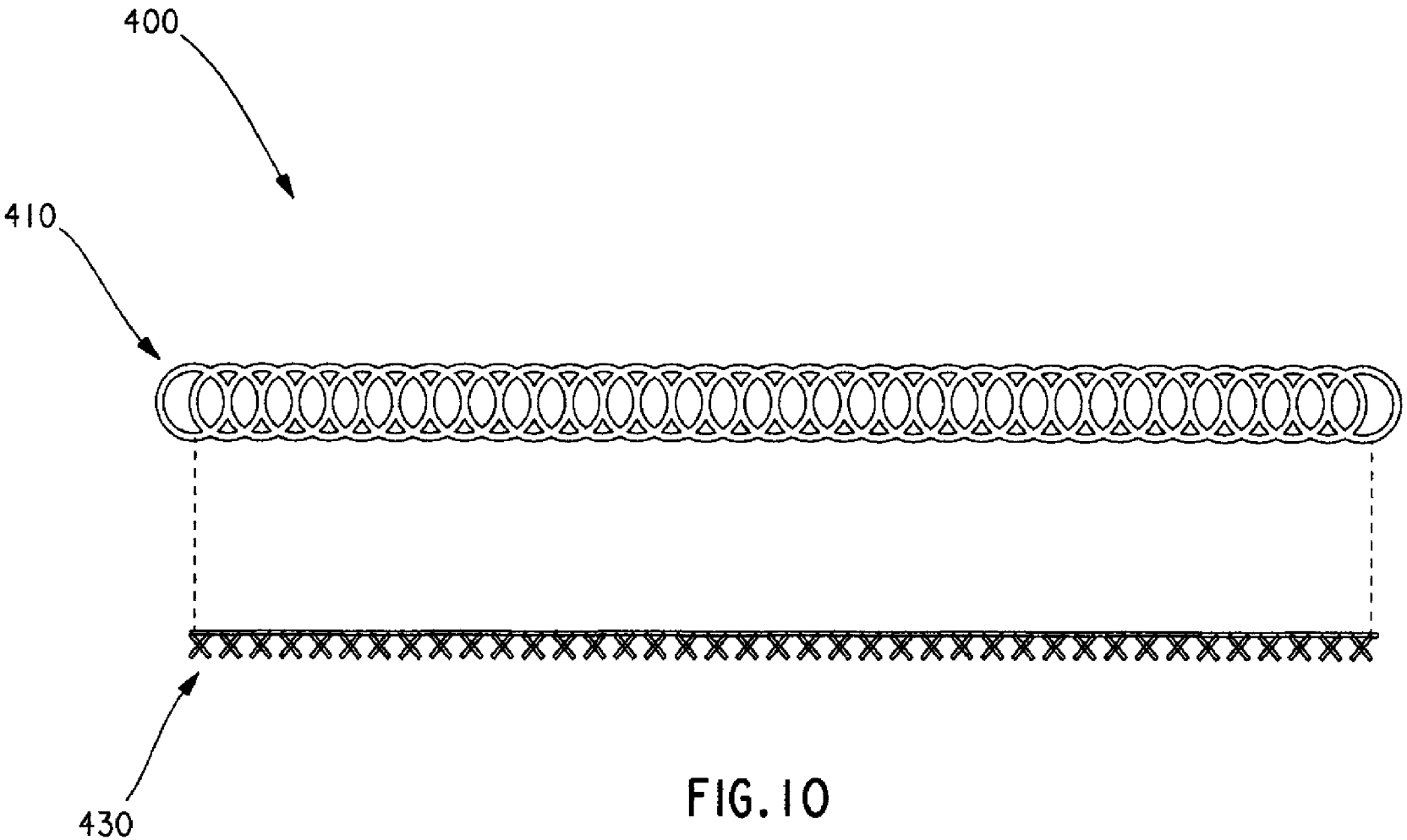
FIGS. 10-13 illustrate construction details for a hook and loop tie according to an alternative embodiment of the present invention.
Figure 11:
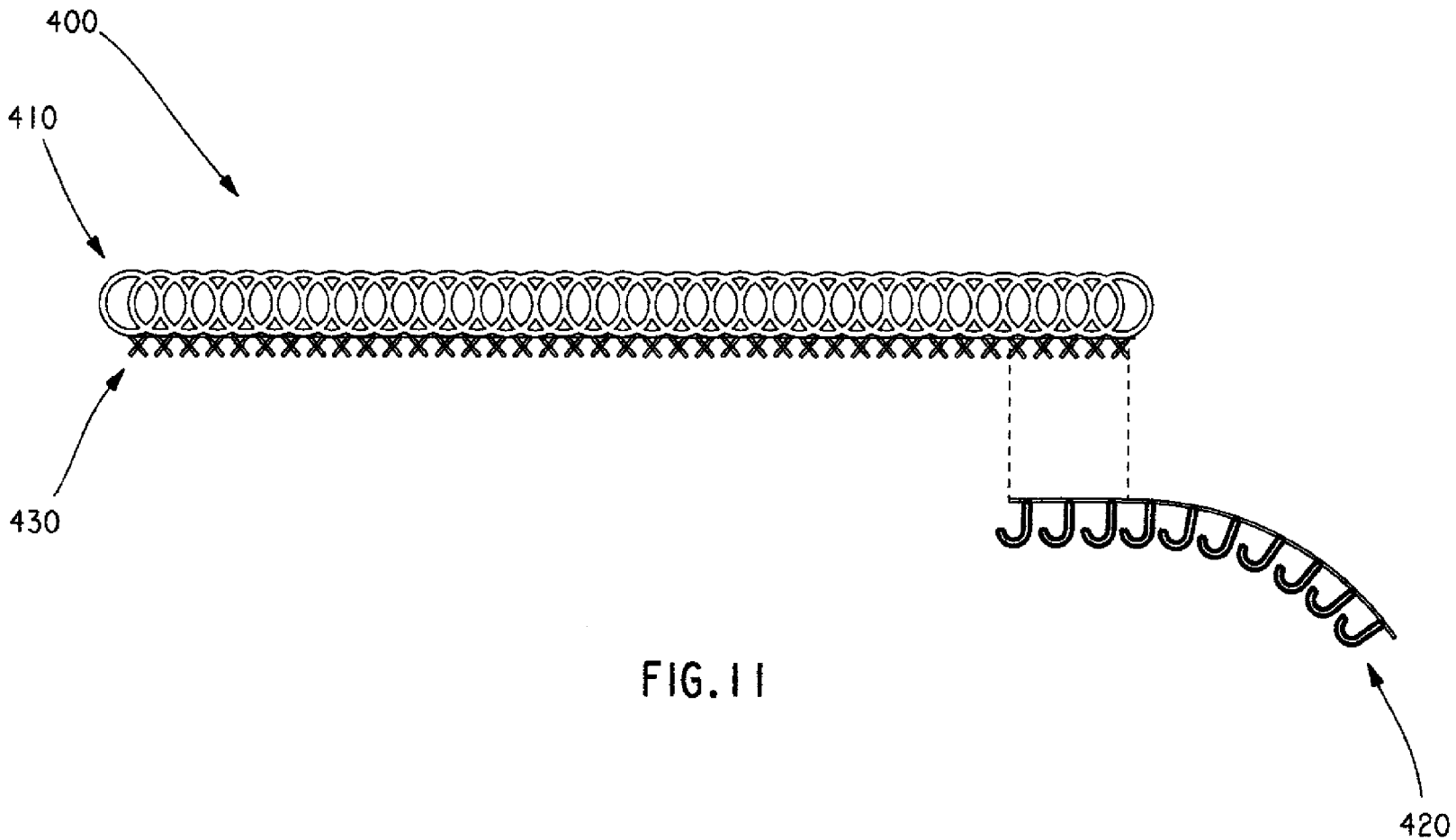
Figure 12:
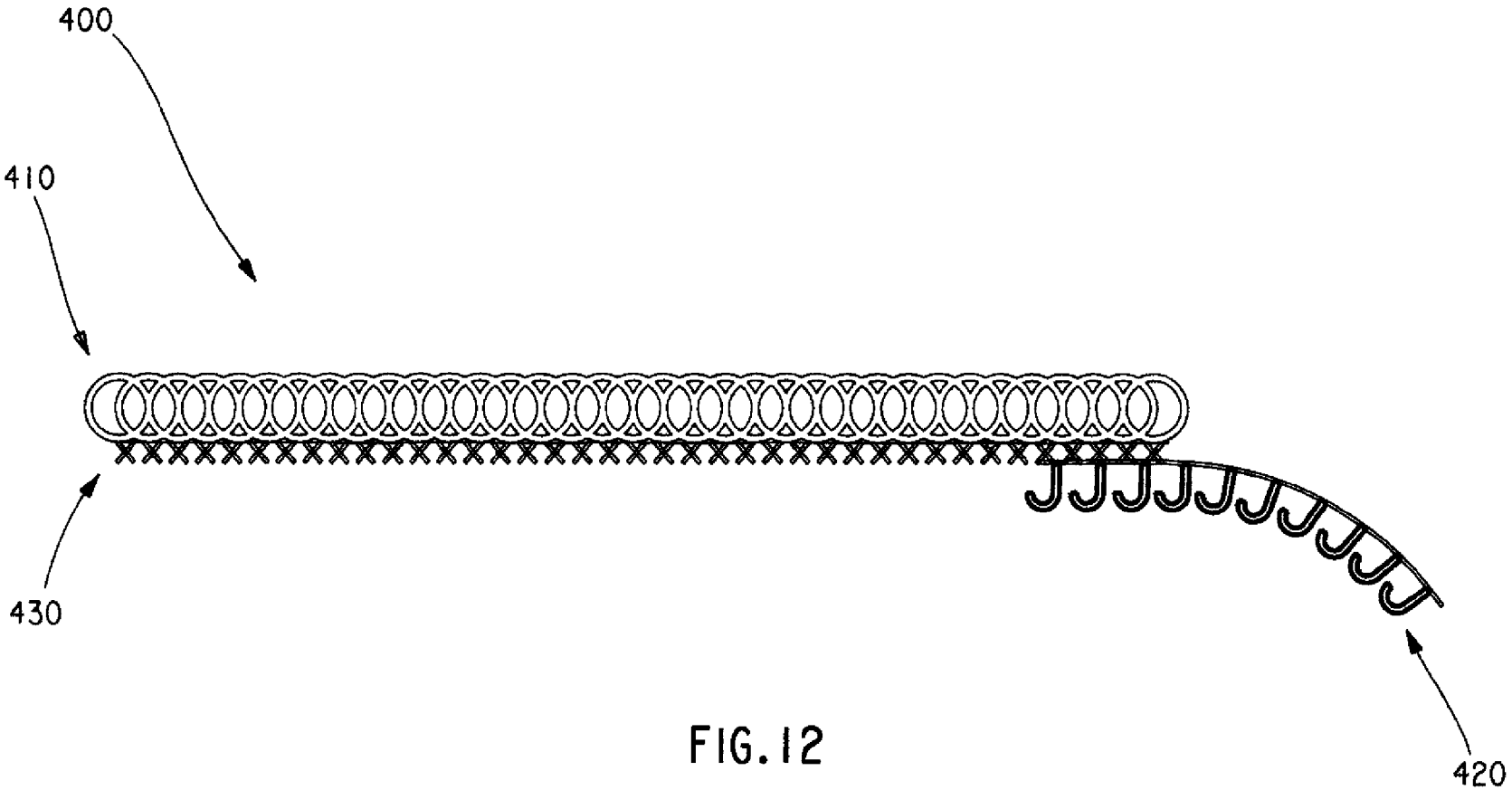
Figure 13:
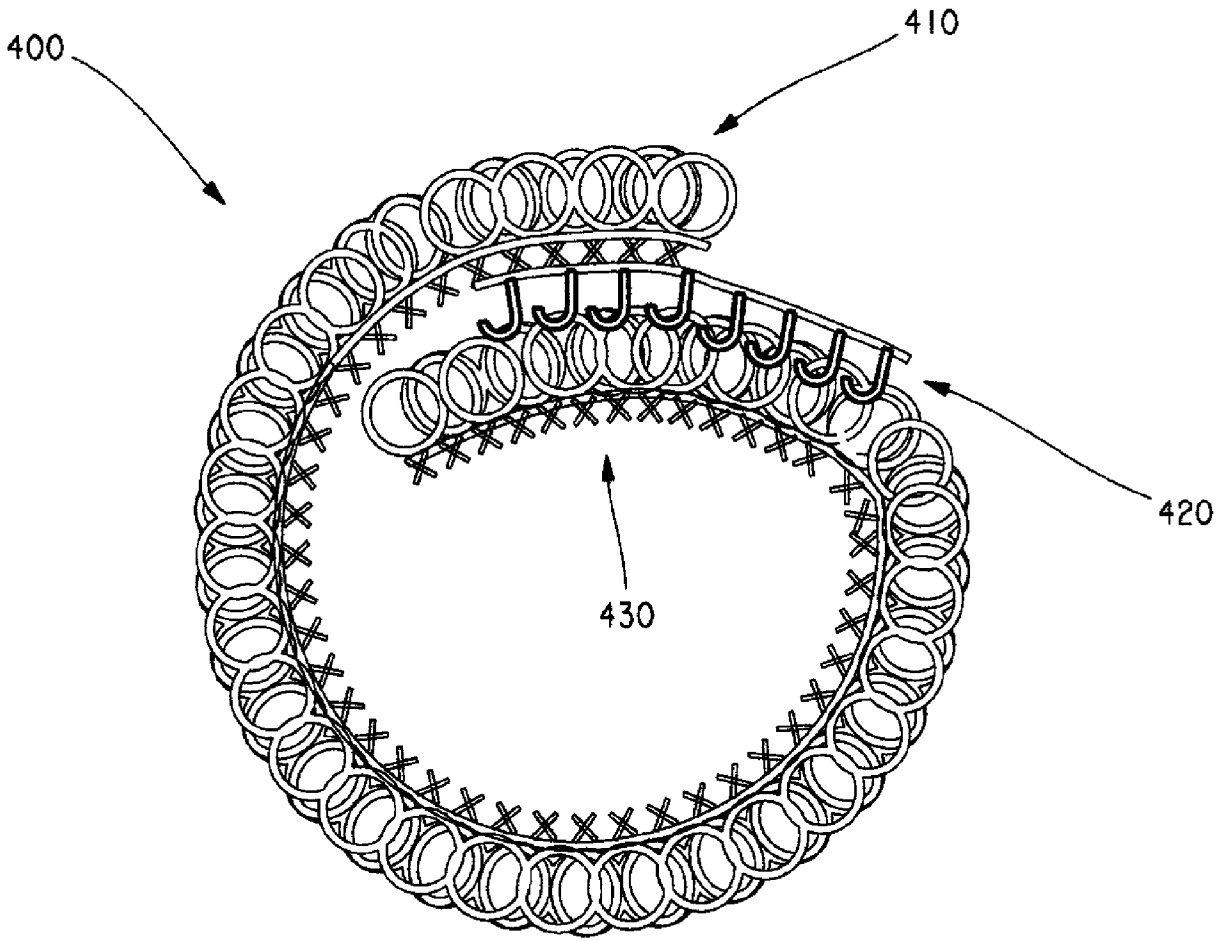

FIGS. 10-13 illustrate construction details for a hook and loop tie 400 according to an alternative embodiment of the present invention. The hook and loop tie 400 is similar to the hook and loop tie 300 of FIGS. 8-9. That is, the hook and loop tie 400 includes a loop component 410, such as a piece of loop fabric, a hook component 420, such as a piece of hook fabric, and differential tape 430, which are similar to the loop component 310, the hook component 320, and the differential tape 330, respectively. However, unlike the hook and loop tie 300, the differential tape 430 is disposed between the loop component 410 and the hook component 420, as best seen in FIG. 11. That is, the differential tape 430 is attached to the loop component 410, as best seen in FIG. 10, and the hook component 420 is attached to the differential tape 430, as best seen in FIG. 11. A finished hook and loop tie 400 is shown in FIG. 12. A bundled tie 400 is shown in FIG. 13.

While the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The illustrated embodiments are examples only and should not be taken as limiting the scope of the present invention. The claims should not be read as limited to the described order or elements unless stated to that effect. Therefore, all embodiments that come within the scope and spirit of the following claims and equivalents thereto are claimed as the invention.

The invention claimed is:

1. A hook and loop tie for securing a bundle of cables, the hook and loop tie comprising:

a loop component, the loop component having a first end, a second end opposite the first end, and a plurality of loop fastening elements;

a hook component affixed to the loop component, the hook component extending from the first end of the loop component toward the second end of the loop component and having a plurality of hook fastening elements; and a non-slip component affixed to the loop component, the non-slip component extending from the second end of the loop component toward the first end of the loop component and overlapping at least a portion of the hook component such that the at least a portion of the hook component is disposed between the loop component and the non-slip component when the hook and loop tie is unwrapped.

2. The hook and loop tie of claim 1, wherein the loop fastening elements and the hook fastening elements are disposed on opposite sides of the hook and loop tie.

3. The hook and loop tie of claim 1, wherein at least a portion of the hook component is curved.

4. The hook and loop tie of claim 3, wherein the loop component conforms to the shape of the curved hook component.

5. The hook and loop tie of claim 1, wherein the hook component extends beyond the first end of the loop component.

6. The hook and loop tie of claim 1, wherein the non-slip component is affixed to the hook component.

7. The hook and loop tie of claim 1, wherein the loop component includes a piece of loop fabric.

8. The hook and loop tie of claim 1, wherein the hook component includes a piece of hook fabric.

9. The hook and loop tie of claim 1, wherein the non-slip component includes differential tape.

10. The hook and loop tie of claim 1, wherein the non-slip component includes pressure sensitive adhesive.

11. The hook and loop tie of claim 1, wherein the non-slip component includes a non-adhesive tacky substrate.

12. The hook and loop tie of claim 1, wherein the hook component is shorter than the loop component.

13. The hook and loop tie of claim 1, wherein the non-slip component is shorter than the loop component and longer than the hook component.

14. The hook and loop tie of claim 1, wherein the loop component is approximately 7 inches in length.

15. The hook and loop tie of claim 1, wherein the hook component is approximately 3 inches in length.

16. The hook and loop tie of claim 1, wherein the non-slip component is approximately 5.5 inches in length.

17. The hook and loop tie of claim 1, wherein the non-slip component includes a first side and a second side opposite the first side, the first side of the non-slip component having a first adhesive for securing the non-slip component to the loop component and the second side of the non-slip component having a second adhesive for securing the hook and loop tie to the bundle of cables before the loop component and the hook component are engaged.

18. The hook and loop tie of claim 17, wherein the second adhesive is removable without leaving a residue.

19. A method of constructing a hook and loop tie for securing a bundle of cables, the method comprising the steps of:

providing a loop component, the loop component having a first end, a second end opposite the first end, and a plurality of loop fastening elements;

affixing a hook component to the loop component, the hook component extending from the first end of the loop component toward the second end of the loop component and having a plurality of hook fastening elements; and affixing a non-slip component to the loop component, the non-slip component extending from the second end of the loop component toward the first end of the loop component and overlapping at least a portion of the hook component such that the at least a portion of the hook component is disposed between the loop component and the non-slip component when the hook and loop tie is unwrapped.

* * * * *